US006990933B2

(12) United States Patent
Casterline

(10) Patent No.: US 6,990,933 B2
(45) Date of Patent: Jan. 31, 2006

(54) HYDRAULIC CONTROL SYSTEM FOR A VARIABLE COMPRESSION RATIO INTERNAL COMBUSTION ENGINE

(75) Inventor: Joseph Edward Casterline, Tucson, AZ (US)

(73) Assignee: Joseph E. Casterline, Tucson, AZ (US)

( * ) Notice: Subject to any disclaimer, the term of this patent is extended or adjusted under 35 U.S.C. 154(b) by 100 days.

(21) Appl. No.: 10/612,526

(22) Filed: Jul. 2, 2003

(65) Prior Publication Data

US 2005/0000475 A1 Jan. 6, 2005

(51) Int. Cl.
*F02B 75/04* (2006.01)

(52) U.S. Cl. ..... 123/48 B; 123/78 F
(58) Field of Classification Search ..... 123/48 B, 123/78 F
See application file for complete search history.

(56) References Cited

U.S. PATENT DOCUMENTS 2,433,639 A * 12/1947 Woodruff et al. ..... 123/48 B
2,589,958 A * 3/1952 Petit ..... 123/48 B

FOREIGN PATENT DOCUMENTS

FR 2647508 A1 * 11/1990

* cited by examiner

*Primary Examiner*—Noah P. Kamen

(57) ABSTRACT

A movable crankshaft assembly is positioned by a positioning device hydraulically connected to a constant pressure hydraulic reservoir. The hydraulic connection between the reservoir and the positioning device is equipped with pressure relief valves connected in parallel to pass fluid in either direction to maintain the same pressure in the positioning device as in the reservoir.

3 Claims, 6 Drawing Sheets

HYDRAULIC CONTROL SYSTEM FOR A VARIABLE COMPRESSION RATIO INTERNAL COMBUSTION ENGINE

TECHNICAL FIELD

The present invention relates to a control system to vary the compression ratio of an internal combustion engine.

BACKGROUND

A major factor affecting the efficiency of an internal combustion engine is the compression ratio. In general, the higher the compression ratio, the more efficient the engine. Unfortunately, there are a number of considerations that impose limits on the maximum value that can be used. Generally, the compression ratio used is based on the one that provides satisfactory anti-knock operation over the anticipated useful power range, with particular attention to full power operation. At full power, the fuel and air mixture enters the cylinder at essentially ambient conditions. The compression raises the pressure and the temperature to a level that will not cause pre-ignition detonation and, after ignition, produces the desired peak pressure in the cylinder. When operating at less than full power, the adiabatic expansion, due to throttling, causes the fuel and air mixture entering the cylinder to be at less than ambient pressure and temperature. These conditions present an opportunity to use a higher compression ratio; in fact, it is possible to produce conditions, prior to and after ignition, similar to those obtained at full power. The desired reduction in power is realized by expanding a smaller volume of gas. The increased compression ratio would increase efficiency. Since most automobiles operate at less than full power most of the time, the ability to vary the compression ratio appropriately would improve efficiency for most operating conditions.

A large number of patents have been issued to vary the compression ratio. These have included various ways to change the length of the connecting rods or to utilize eccentric members on the crankshaft or connecting rods which, when rotated, change the compression ratio. None of these patents has resulted in a commercially viable product, largely due to complexity and uncertainty about their efficacy.

SUMMARY OF THE INVENTION

The control system covered by this patent uses the peak pressure in the cylinder after ignition as determined by the peak piston force on the crankshaft as a control objective. The hydraulic pressure in the constant pressure reservoir is maintained at a value that provides the hydraulic positioning device with a pressure that balances the maximum force after ignition exerted on the crankshaft by the pistons when operating at full power and design compression ratio. When operating at less than full power, the force on the crankshaft will be reduced and fluid will be transferred from the constant pressure reservoir to the hydraulic positioning device, moving the assembly closer to the engine block. This will increase the compression ratio until the maximum force exerted on the crankshaft after ignition is the same as that produced by the engine when operated at full power and design compression ratio. For specific engines, at very low power levels, mechanical constraints will prevent realization of the full benefit over a small portion of the usable power range. When power is increased from a lower level to a higher level, the force exerted on the crankshaft by the pistons will increase and fluid will flow from the positioning device to the constant pressure reservoir, moving the crankshaft away from the engine block, thereby lowering the compression ratio to the one that produces the desired maximum pressure in the cylinders after ignition.

When power is increased, the pressure relief valve that permits hydraulic fluid to flow from the hydraulic positioning device to the constant pressure reservoir will open, moving the crankshaft assembly away from the engine block (reducing compression ratio). This valve is large to permit rapid fluid flow, preventing overpressure. When power is decreased, the pressure relief valve that permits hydraulic fluid to flow from the constant pressure reservoir to the hydraulic positioning device (increasing compression ratio) is small and orifaced or equipped with a short time delay to prevent undesirable movement between power strokes.

DESCRIPTION OF THE PREFERRED EMBODIMENTS

Figure 1:
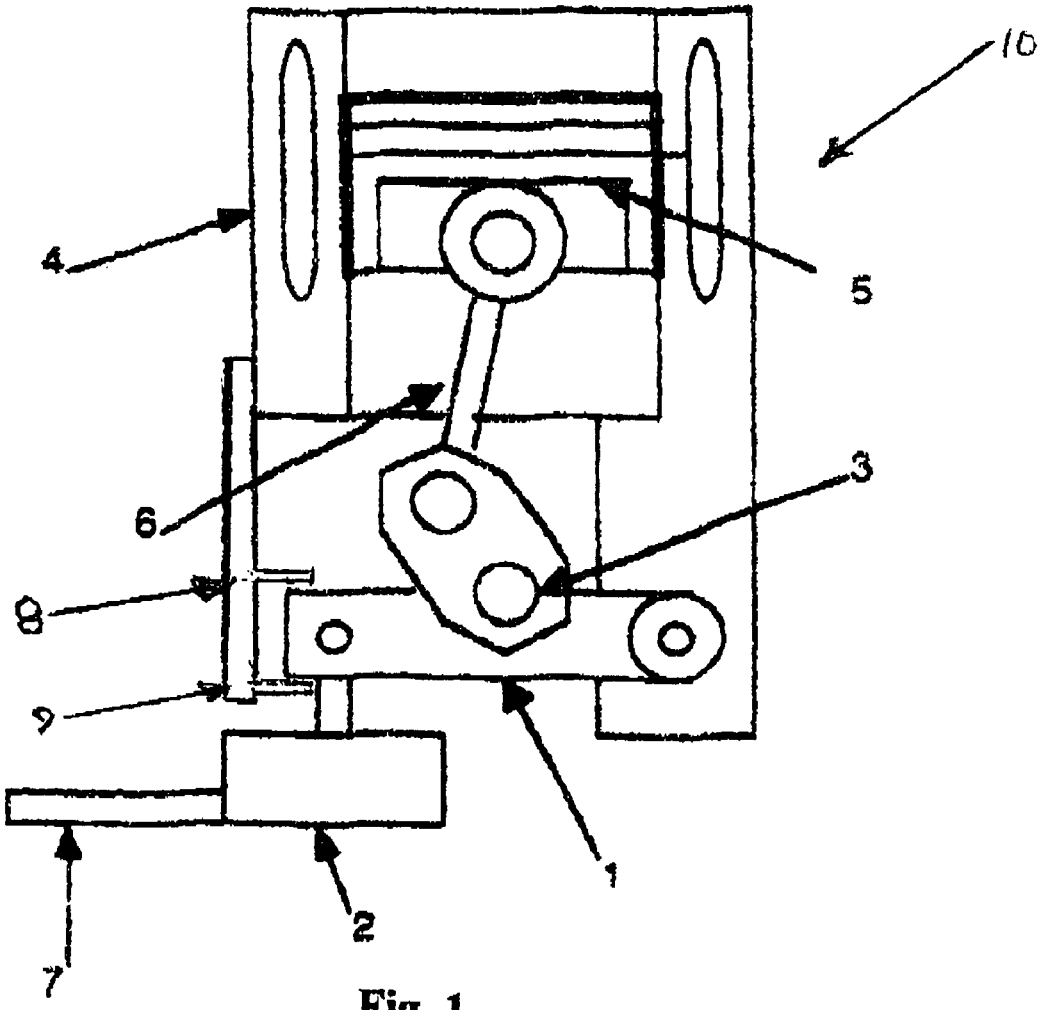
FIG. 1 is a schematic arrangement of engine block, hinged crankshaft assembly and hydraulic positioning device.

Referring to FIG. 1, a hydraulic control system 10 includes an engine block 4 a piston 5, a connecting rod 6, a crankshaft 3, a hinged movable crankshaft assembly 1, a hydraulic positioning device 2, a maximum limiting stop 8, a minimum limiting stop 9, and hydraulic tubing 7.

Figure 2:
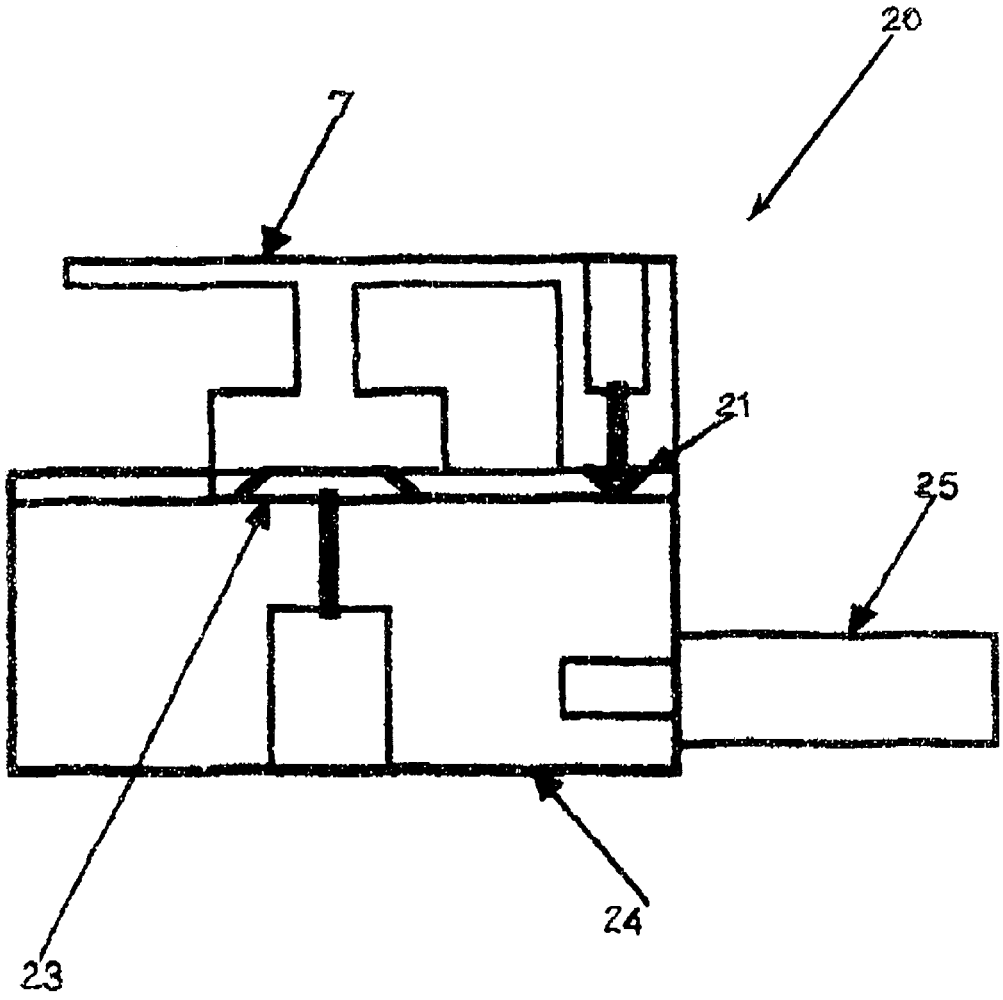
FIG. 2 is a schematic arrangement of constant pressure hydraulic fluid reservoir with tubing and pressure relief valves.

Referring to FIG. 2, the hydraulic fluid constant pressure reservoir 20 includes a spring-loaded piston to maintain desired hydraulic pressure 25, a pressure relief valve 23 allows fluid to pass from the hydraulic positioning device to the hydraulic fluid reservoir 24, and a pressure relief valve 21 allows fluid to flow from the reservoir to the hydraulic positioning device. Tubing 7 connects the hydraulic reservoir with the hydraulic positioning device.

Figure 3:
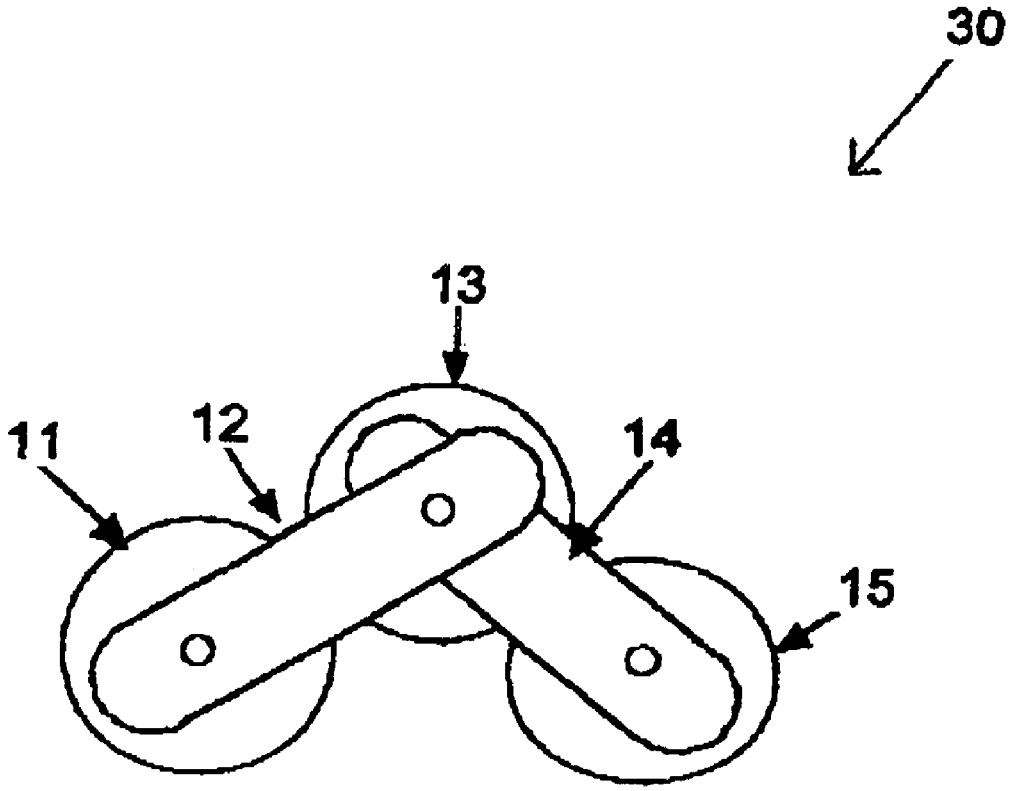
FIG. 3 is an operating cycle at full power and design compression ratio of 7:1.
Figure 4:
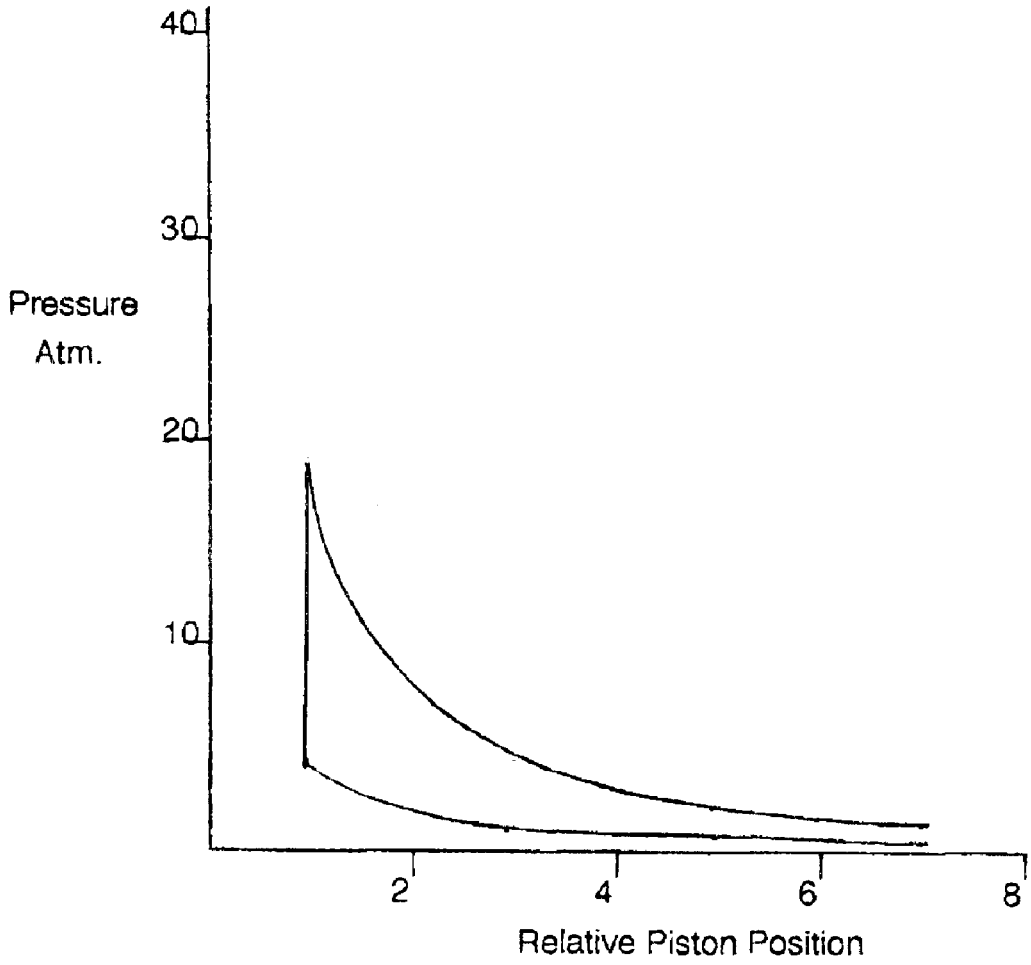
FIG. 4 is an operating cycle at 34% power and design compression ratio of 7:1.
Figure 5:
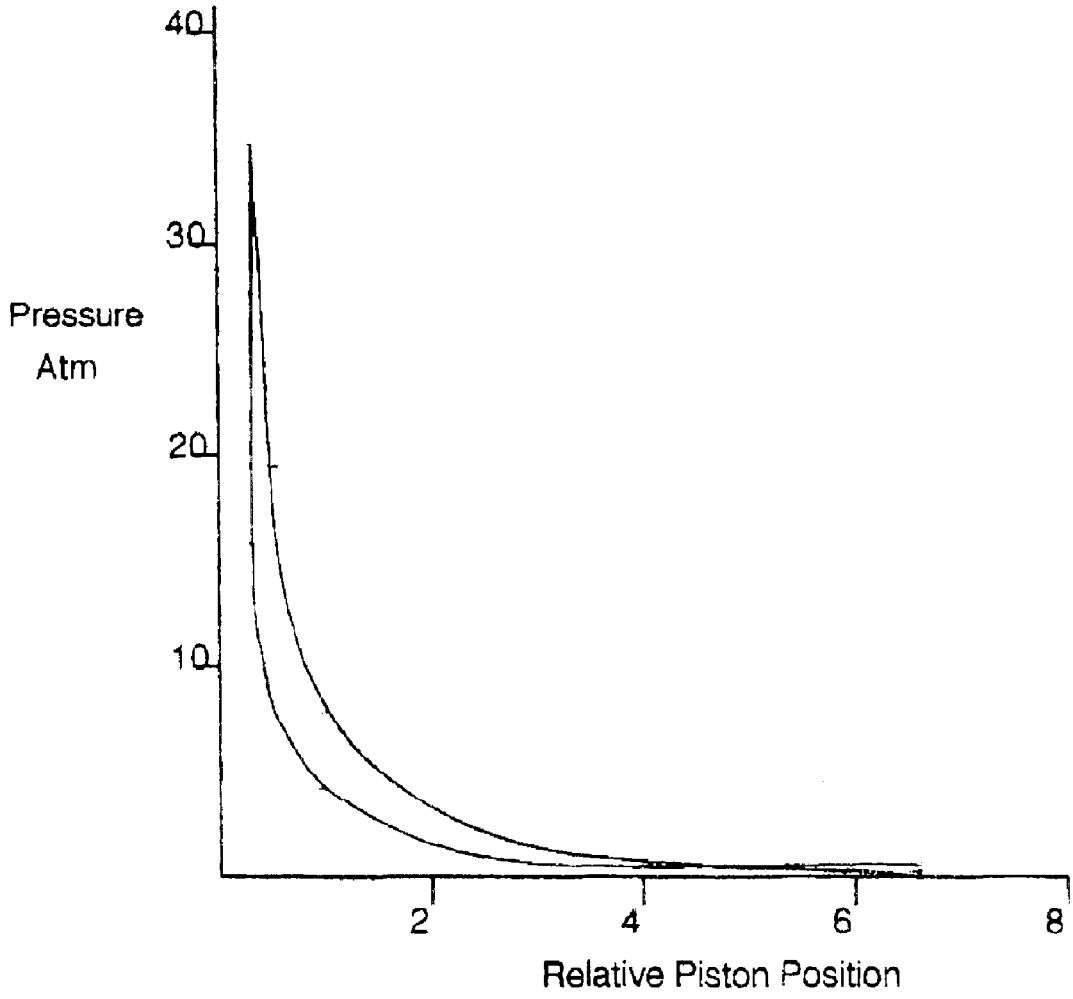
FIG. 5 is an operating cycle at 34% power and compression ratio of 19:1.
Figure 6:
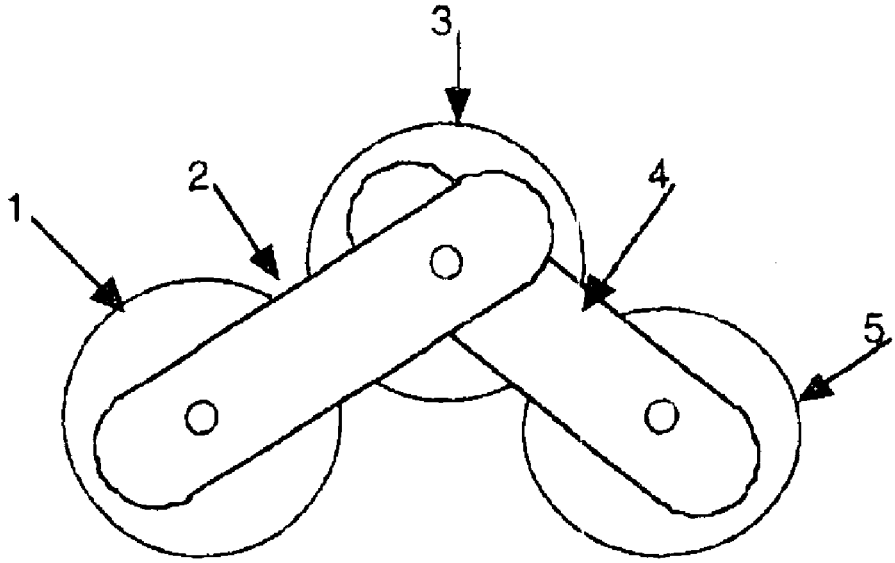
FIG. 6 is a coupling between the moveable crankshaft assembly and the drive train.

Referring to FIG. 3, a geared coupling 30 between a movable crankshaft and a drive train includes a gear 11 attached to a moveable crankshaft, an idler gear 13, and a drive train gear 15 attached to a drive train. Bracket 12 connects gears 11 and 13, and bracket 14 connects gears 13 and 15.

What is claimed is:

1. A control system for varying the compression ratio of an engine cylinder, comprising:

a crankshaft assembly including a maximum limiting stop and a minimum limiting stop;

a hydraulic positioning device connected to the crankshaft assembly, said positioning device adapted to move the crankshaft assembly within a range defined by the maximum limiting stop and the minimum limiting stop;

a constant pressure reservoir;

a hydraulic connection between the constant pressure reservoir and the hydraulic positioning device.

2. The control system of claim 1, wherein a constant pressure is maintained between the hydraulic reservoir and the constant pressure reservoir.

3. The control system of claim 1, wherein the positioning device is a hydraulic cylinder containing a piston.

* * * * *